US007398889B1

(12) United States Patent
McNulty

(10) Patent No.: US 7,398,889 B1
(45) Date of Patent: Jul. 15, 2008

(54) ROTATING BARREL STORAGE SYSTEM

(76) Inventor: John M McNulty, 215 Duke Dr., Sequim, WA (US) 98382

( * ) Notice: Subject to any disclaimer, the term of this patent is extended or adjusted under 35 U.S.C. 154(b) by 52 days.

(21) Appl. No.: 11/419,573

(22) Filed: May 22, 2006

Related U.S. Application Data

(60) Provisional application No. 60/688,022, filed on Jun. 7, 2005.

(51) Int. Cl.
*A47B 73/00* (2006.01)

(52) U.S. Cl. ..... 211/77; 211/74; 211/163

(58) Field of Classification Search ..... 211/74, 211/77, 78, 70, 163, 144; 312/311, 305, 312/135, 204; 217/72, 73
See application file for complete search history.

(56) References Cited

U.S. PATENT DOCUMENTS

| | | | | | |
|---|---|---|---|---|---|
| D255,067 | S | * | 5/1980 | Furnell | D6/421 |
| 4,274,216 | A | * | 6/1981 | Boyd | 40/306 |
| 4,367,695 | A | | 1/1983 | Lance | |
| 4,460,221 | A | * | 7/1984 | Dimino | 312/277 |
| 4,531,645 | A | * | 7/1985 | Tisbo et al. | 211/131.1 |
| 4,753,495 | A | * | 6/1988 | Swink | 312/114 |
| 5,031,779 | A | * | 7/1991 | Szenay et al. | 211/40 |
| 5,183,165 | A | * | 2/1993 | Acona et al. | 211/77 |
| D348,182 | S | | 6/1994 | Young | |
| 5,403,079 | A | * | 4/1995 | Fetisoff | 312/204 |
| D386,910 | S | | 12/1997 | Saiger | |
| 5,848,534 | A | * | 12/1998 | Stauffer | 62/91 |
| 6,086,171 | A | * | 7/2000 | Ashley et al. | 312/97.1 |
| D446,052 | S | | 8/2001 | Bourne | |
| 6,425,647 | B1 | * | 7/2002 | Pothin | 312/249.2 |
| D466,269 | S | | 11/2002 | Falland | |
| 6,585,119 | B2 | * | 7/2003 | Palder | 211/49.1 |
| 6,616,002 | B2 | | 9/2003 | Weil | |
| D483,202 | S | | 12/2003 | Slemmons | |
| D487,365 | S | | 3/2004 | Bourne | |
| 7,163,108 | B2 | * | 1/2007 | Lyons et al. | 211/1.56 |

OTHER PUBLICATIONS

2 Day Design website pages, www.mohawkathome,com, May, 11, 2006.
Dax Stores websites pates, www.daxstores.com, May 11, 2006.

* cited by examiner

*Primary Examiner*—Jennifer E. Novosad
(74) *Attorney, Agent, or Firm*—Innovation Law Group, Ltd.; Jacques M. Dulin, Esq.

(57) ABSTRACT

Storage units of standard, new or used wood stave barrels, mounted on end on a rotating platform and having a side opening cut-out to the interior for access to shelving, drawers, wine racks or other storage devices fitted in the interior. The barrel is mounted on and secured to a rotatable platform that includes a turntable mechanism, the platform being specifically sized to fit inside the base recess of the barrel, so that it is hidden by the barrel lip, yet holds the barrel sufficiently off the ground to clear carpeting or other irregular flooring such as slate, brick or tile pavers, that might otherwise interfere with its rotation. The platform includes friction sliders so that the barrel rotates under hand pressure but does not spin freely. Selected feet or spacer disks are used to provide minimum needed clearance so the barrel appears to float just above the flooring surface.

20 Claims, 9 Drawing Sheets

ROTATING BARREL STORAGE SYSTEM

CROSS REFERENCE TO RELATED APPLICATIONS

This is the Regular US Patent Application of prior Provisional Application Ser. No. 60/688,022 filed Jun. 7, 2005 by the same inventor under the same title, the priority of which is claimed under 35 US Code, Sections 119, 120, ff, and the disclosure of which is hereby incorporated by reference.

FIELD

The invention relates to storage systems, more particularly to furniture storage units made from standard, new or used wooden liquor, nail, wine, beer or water barrels, mounted on a rotating platform and providing access to the interior for a wide range of shelving, drawers and racks. In the preferred embodiment, used wine barrels contain wine racks which provide a novel enological connection between the barrel's former use of holding wine, and its inventive use for storing bottled wines, spirits or other valuable commodities.

BACKGROUND

The use of wine barrels (especially oak barrels) to store and age wine is a centuries old tradition. Wine aged in oak barrels is enhanced with the addition of flavors and oak overtones imparted by the wood. But by the time a barrel is about 5 years old, it is virtually neutral as far as its influence on the taste of the wine. Since new barrels impart more flavors to the wine than previously used barrels, a large quantity of new barrels are used by wineries each year, and many used barrels are discarded. Some are turned into outdoor planters, others are used in furniture making, and some are relegated to the burn pile. But many people recognize the age-old art of the cooper, carefully steaming and bending wood, and fastening the vertical staves circumferentially with metal rings or hoops.

Americans' wine consumption has been steadily increasing over the past 10 years. Per capita, Americans annually consume 12 liters (according to the 2000 Census data). The average American wine drinker maintains a small store of wines, either purchased or received as gifts. For those who make an effort to store the bottles horizontally and away from heat, there are few aesthetically pleasing options besides the open wine rack.

Accordingly, there is a functional and aesthetic need to utilize a resource that is routinely discarded by the wine industry, and use it produce a furniture quality wine storage system.

THE INVENTION

The invention comprises a wooden barrel, preferably used, oriented upright (on one end), that is retrofitted with a large opening in the staves and a wine rack or other storage device fitted in the interior and accessible through the side opening, which is mounted on a rotatable platform that includes a turntable mechanism. The rotational platform is specially sized to fit inside the base recess of the barrel, so that it is hidden by the barrel lip, yet holds the barrel sufficiently off the ground to clear carpeting or other irregular flooring such as slate, brick or tile pavers, that might otherwise interfere with its rotation. Standard wooden stave barrels can be configured in the inventive storage system to hold several cases of wine. By way of presently preferred example, the opening provides access to an internal rack to hold 24-to-30 750 ml or larger wine bottles.

The platform includes a rotation mechanism broadly defined as a "rotation assembly" and is preferably a ball bearing turntable comprising metal, wood or plastic plates that rotate with respect to each other on ball bearings captured between them in a race mechanism. These are also known as "Lazy Susan" turntables. For this invention it is an important feature that the retrofitted barrel, including the stored contents, which may have substantial weight in excess of 100 pounds, moves smoothly under a small rotational force, but not so easily that it spins non-stop. Accordingly, special stabilizing and leveling members having sliding faces are provided in the platform surrounding the turntable to provide a pre-selected amount of resistance to rotation, so that the inventive storage assembly rotates smoothly and easily when mounted on the platform but is not free-wheeling. Thus, the inventive barrel assembly stops when rotational force is removed or expended, and stays at rest in the new, stopped position. The stabilizers are conveniently discs, blocks or rings, having low friction surfaces, placed between the mounting discs. The degree of frictional resistance is selected (increased or decreased) by adjusting the gap between the platform disks (within which the turntable is mounted) so as to control the clearance between the face of the stabilizers and the opposing platform member (disk) which the stabilizers contact.

To create an opening large enough to enable easy access to 24-30 bottles of wine, a rectangular opening is carefully cut into one side of a used wooden wine barrel. Wine barrels are typically constructed with many vertical wooden staves held together by 4 to 8 external metal hoops. To maintain the structural integrity of the barrel, at least one of the top and one of the bottom hoops are kept intact, e.g. in a 6-hoop barrel; in an 8-hoop barrel, preferably 2 top and bottom hoops remain intact) while the middle hoops are cut along the perimeter of the rectangular storage opening. The cut hoops are then removed from the barrel, drilled with holes to permit refastening with screws permanently back onto the barrel, and treated, painted, sandblasted or cleaned to provide a pleasing, furniture-quality patina. Screws and/or nails are used to secure the remaining barrel hoops in place. One or more partial hoop(s) may be placed inside along or above and below the horizontal mid-line (the barrel "equator") and screwed to the inner surface of each of the staves to provide structural reinforcement. Hoops may also be bonded to staves using wood glue.

In a first embodiment, the barrel opening is sized to hold a custom-made or off-the-shelf wine rack, typically holding around 30¾-liter bottles of wine. Because the barrel's diameter is larger than the length of a typical wine bottle, a back or stops are affixed to the wine rack, to provide a rear stop for each bottle. Alternately, un-utilized space behind the rack may be used for hidden storage of valuables. In another embodiment, the rack may be mounted to the inside of the barrel end (bottom and/or top) on tracks (e.g. drawer slides) so the rack can be pulled out to reveal the storage and provide access thereto and to the wine bottles.

The wine barrel is fitted onto a specially sized rotating platform comprising a custom-made turntable mechanism, preferably including two circular disks, typically made of wood, such as plywood, chipboard, MDF or press-board. The base of most wine and spirits barrels is about 22", and the following assembly fits easily inside the recessed bottom of most barrels.

Two, approximately 20" diameter disks are placed one above the other, with ball bearing turntable hardware (typically 6" for 500 pound load limit, or 12" for 1000 pound load limit) centered, between the two disks. For a strong, non-drag clearance of approximately ¼" that must be maintained between the metal plates of the turntable, it is preferred to use flat-head elevator or connector bolts, lock washers and nuts to fasten the top ball bearing plate to the top disk, instead of manufacturer-recommended self-tapping sheet metal screws. These bolts provide a better, non-interfering separation between the metal plates of the ball bearing turntable, assuring that adding weight to the barrel will not jam or otherwise adversely impact the turntable function.

In addition, stabilizing members comprising glide or slide plates, pads or disks (typically ¾" diameter, HDPE or polytetrafluoroethylene-faced disks specified for up to 1600 pound capacity), are fastened around the outer edges of the turntable assembly between the two disks (preferably to the upper face of the lower disk with the smooth, low friction face "UP") to provide selected drag resistance on the upper platform disk to slow the ball bearing mechanism down, to aid in smooth turning, to provide a stable separation between the bottom and top turntable disks, and to prevent the turntable assembly from tilting if the weight of the stored wine is not balanced. A third platform spacer disk is fastened to the top of the upper rotating disk or the bottom of the lower disk, to act as a spacer that lifts the recessed bottom of the barrel an additional ⅛"-½"" off the floor. Alternately, lifter feet may be fastened to the bottom of the lower turntable disk, to further raise the rotating platform an amount to compensate for the depth of the recess of the barrel base, so as to raise the rotating platform mechanism. The platform assembly may be permanently fastened to the wine barrel, or the barrel may simply sit on top of the platform; the barrel's weight (approximately 110 pounds empty and 160-180 pounds loaded) and the snug fit of the barrel bottom over the platform edges produces a stable mounting. Where feet are used, they may be adjustable to level the barrel top, in the case of irregular or canted flooring.

With the spacer and/or feet suitably sized to lift the recessed bottom of the barrel so that its bottom edge is slightly above floor level, the barrel appears to be resting on end on the floor like any other piece of permanent furniture. But when access is needed, the barrel can be easily rotated to bring the storage opening to the front for access. When access to the storage area is not needed, the barrel is rotated so that the open storage access is in back, hidden from view (i.e., against a wall). When properly placed in the rack cradles, no bottles extend beyond the edge of the barrel stave sides; the bottles are protected by the barrel as the opening is rotated out of sight.

The result of turning the barrel is that it appears to be wholly intact, with its metal hoops exposed. When access to the storage area is needed, the barrel is rotated to bring the opening to the front, where horizontally stored wine bottles are easily accessible.

In an alternate embodiment, barrels may be fitted with a second, inner turntable any selected distance above the bottom on which is mounted a wide variety of racks having, for example, recesses for upright liquor bottles, a hidden safe for valuables, or simple shelving. For the upright spirits or wine rack, a large disc, on the order of 24", is spaced on the order of 2"-3½" above and secured to the upper turntable disc.

The interior space of the barrel storage unit can accommodate a waste can or basket, clothing hamper, file cabinet (e.g. 2-drawer, 8½×11), safe, multi-shelf unit (e.g. shoe bin), two or more spaced shelved (e.g. 3 counting the bottom as a shelf), fixed or rotating on a center spindle (like kitchen corner cabinet lower Lazy Susan units), for storing canned or jar-packed foods, audio-video tapes/discs or books.

The bung hole may be preserved as part of the "front" of the barrel, or it may be part of the removed section. Where the bung hole is retained, it may be fitted with a bung or it may serve as a finger hole to aid in rotation.

In addition the free end of the barrel, now the "top" due to the vertical orientation of the barrel, is useful as a tabletop, e.g. for a lamp, or from which to present and serve cheese, wine, assemble empty wine glasses for guests and the like. As such the top can serve as a small phone table, with the telephone on top, and the interior space of the barrel used for phone books, note pads and the like, stored on shelving. The top can be fitted with a larger diameter wood top that includes spacers to engage the stave rim to serve as a full-sized café or dining table. The external wall of the barrel can be fitted with small, curved towel bars. The top face can include slots for knives for cutting cheese, bread, and the like.

BRIEF DESCRIPTION OF THE DRAWINGS

The invention is described in detail by reference to the drawings, all of which are electronic photographs of an actual, full sized prototype of the inventive tube trap in which.

DETAILED DESCRIPTION OF THE INVENTION, INCLUDING THE BEST MODE

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

The Figures are numbered and annotated so that one skilled in the arts of woodworking and metal smithing, by reference to the attached parts list will easily be able to understand the materials and method of construction and will be able to easily assemble the parts to achieve the functionality shown.

It should be understood that barrels are made with various numbers of hoops, typically as few as four and as many as eight. Thus, the drawings show representative hoop numbers and placement, but the invention is not limited to those configurations. In addition, the invention includes the optional provision of internal partial hoops to stabilize the barrel when the stave wood dries out. Any number of internal hoops may be used, typically one placed at the horizontal mid-point, the widest part of the barrel, but a pair can be used, placed above and below the mid-point. Thus any combination of internal and external hoops can be used. The internal partial hoops are C-shaped in plan view, and are drilled with holes through which securing screws are passed to fasten the staves, typically one screw per partial hoop per stave.

Figure 1A:
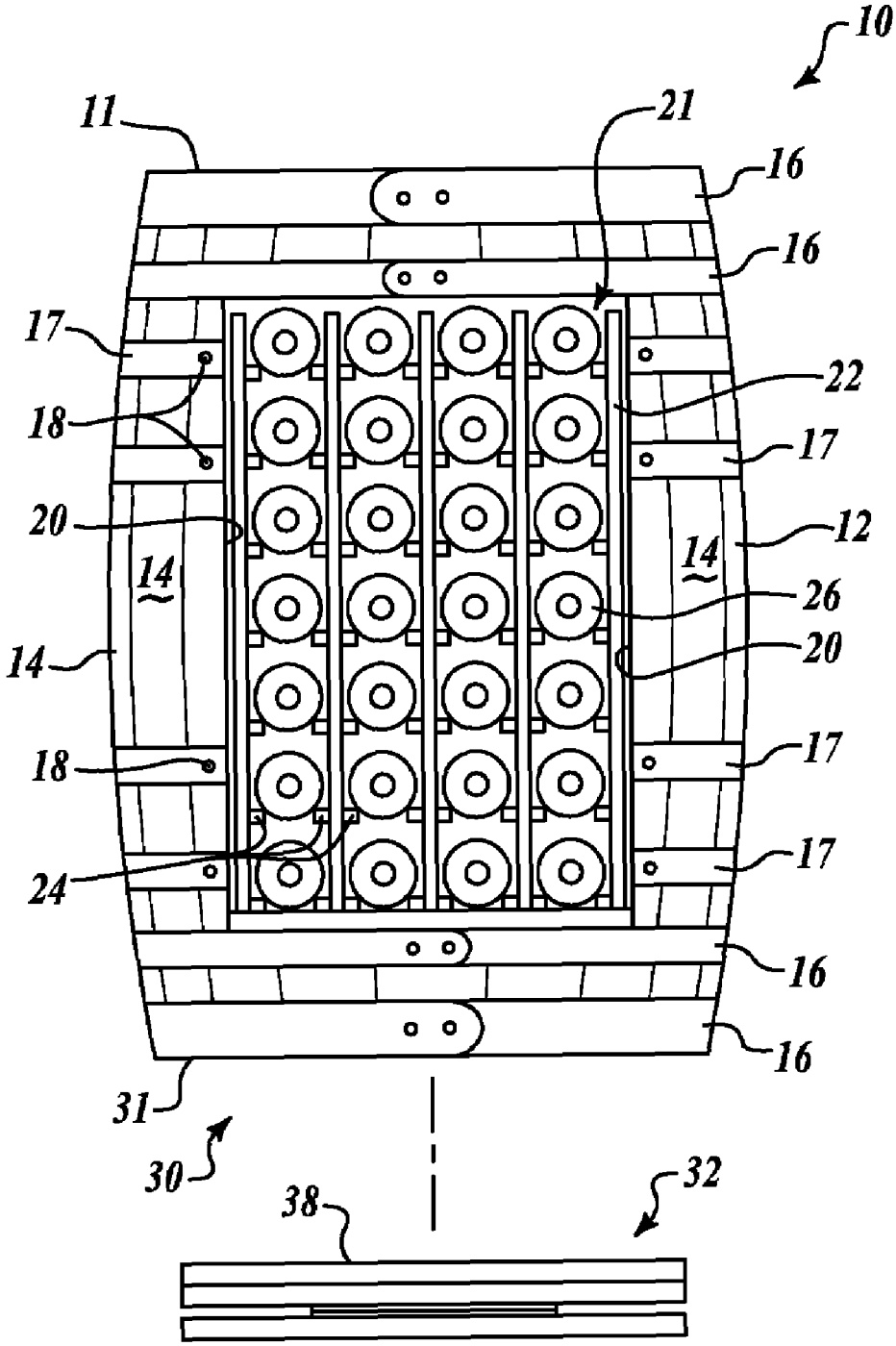
FIGS. 1A and 1B are elevation views of a first embodiment of the inventive barrel storage system with the rotational platform unit, as assembled, exploded below the barrel bottom end, in which FIG. 1A rotated on the platform to show the storage side (called the back) and FIG. 1B rotated to show the front side; rotated from the front and back.

FIG. 1A shows in elevation the storage entry side (the back side) of the inventive barrel storage system 10 in which the barrel is oriented upright resting on its bottom edge 31. The mid-section 20 of approximately ¼ of the barrel staves 14 and external hoops 17 have been removed to form an opening for access to the internal volume of the barrel for storage. As shown in FIG. 1A, the preferred construction is to remove a section of a hoop on each side, so that at least a partial stave frames the sides of the storage opening. In the alternative, the opening can be oriented co-ordinate with full staves. That is, only a selected number of full staves, e.g., 4-6 are removed, thus obviating a vertical cut up one or more staves to form the access opening sides.

Wine rack 22 is recessed into the internal storage volume 21 of wine barrel 12, having a plurality of individual cradles, supports or slots 24, in this example, twenty eight bottles of wine 26. Full circumference external hoops 16 are visible at the top and bottom of the opening, and partial (cut) external hoops 17 terminate at the side edges of the opening 20, and are held in place with hoop screws 18. This side of the barrel is normally rotated out of sight so it is termed the "back" side.

The barrel 12 is secured to and resting on a rotational platform 32, the vertical height of which is selected to provide suitable clearance of the bottom edge above the flooring surface (shown best in FIGS. 3A, 3C and 3D) to permit the barrel to be rotated. The bottom of the barrel 31 (best seen in FIG. 2) is secured to the top plate or spacer disk 38.

Figure 1B:
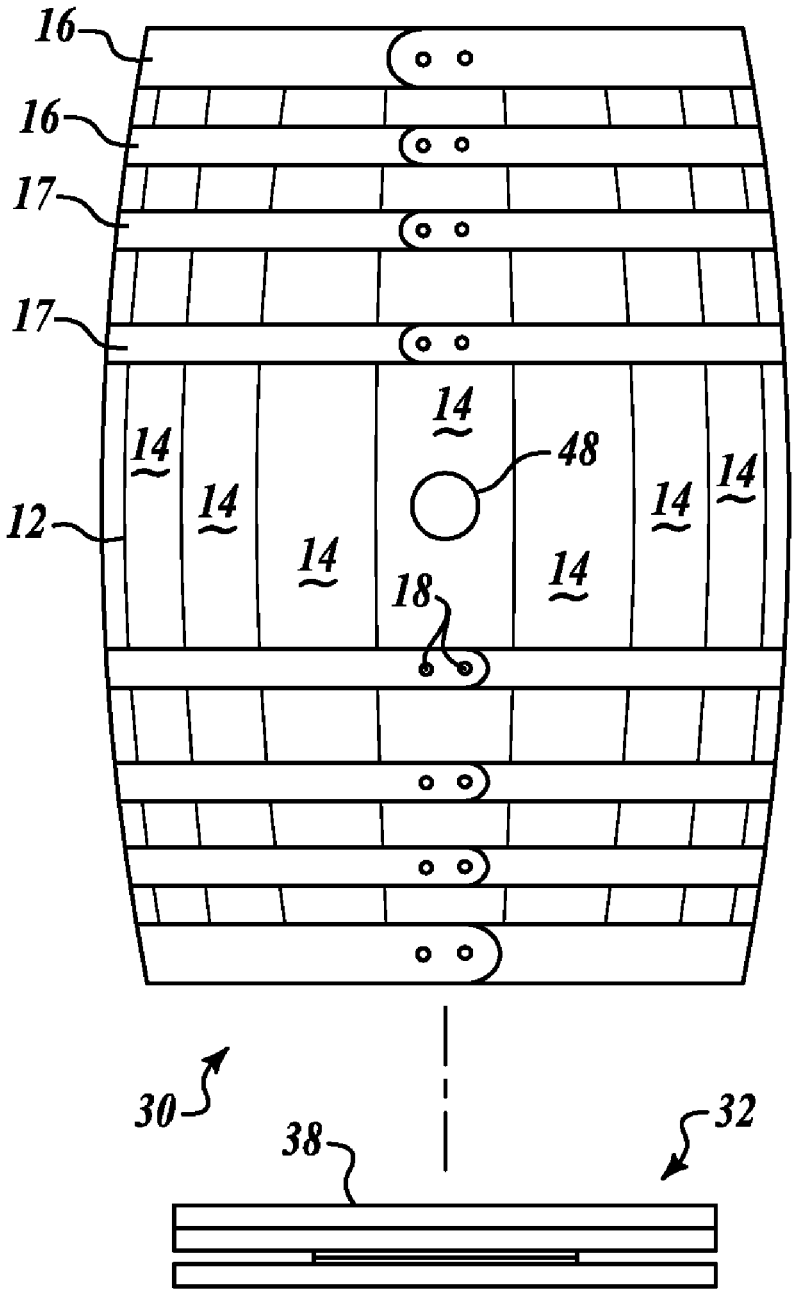

FIG. 1B is an elevation view of the inventive barrel storage system 10, rotated on the platform 32 to show the "front" side. The barrel appears entirely intact, with eight hoops 16 and 17, all appearing to extend the full circumference around the barrel. In this example, bung hole 48 has been retained and is visible in one of the wooden staves 14. The hole can serve as a finger purchse point to rotate the barrel if desired. The barrel appears to be sitting on the floor; as the rotational platform 32 is essentially hidden from view, being secured to the bottom of the barrel 31 in the recess formed by the barrel lip 30.

Figure 2:
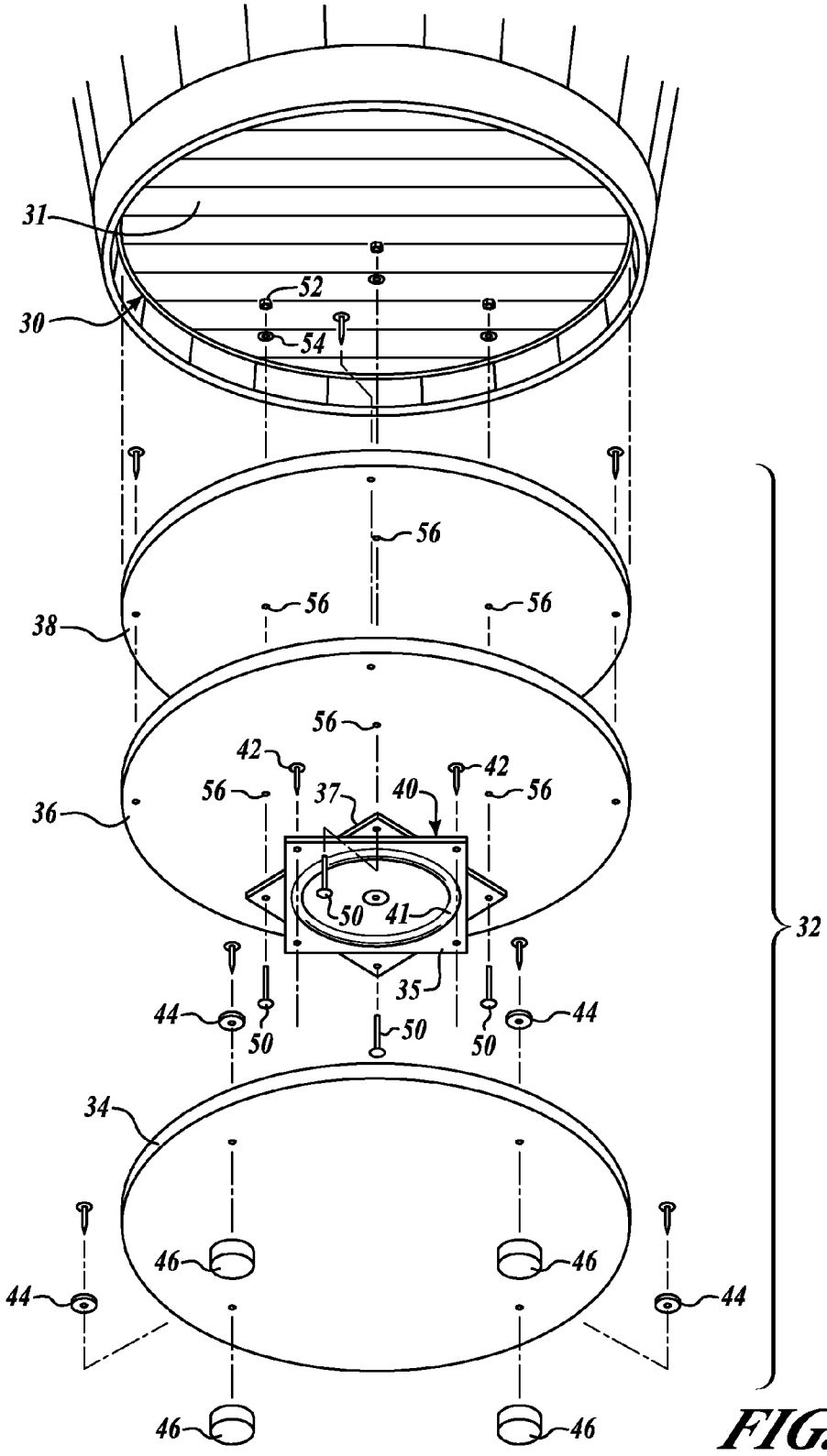
FIG. 2 is an exploded isometric view of the inventive rotational platform showing the turntable assembly and one mode of mounting it to the bottom end of the barrel.

FIG. 2 is an exploded view of the rotational platform assembly 32, including the two-part ball bearing turntable assembly 40 connected to upper and lower disks 36, 34, and showing one mode of mounting the platform to the bottom of the barrel 31. The bottom plate 35 of ball bearing turntable assembly 40 (with internal ball bearing retainer race assembly 41) is fastened to the bottom disk of the platform 34 with screws 42. The top disk 36 and spacer disk 38 of platform 32 are fastened to the top plate 37 of ball bearing turntable assembly 40 with longer (1½-2") elevator or connector bolts 50 which, when tightened through pre-drilled holes 56 to a washer 54 and nut 52, secure the rotational platform assembly 32 together. Multiple alternative modes of securing the platform to the bottom of the barrel are shown in FIGS. 6A-6E, below. To further assure smooth turning under the loaded weight of the barrel storage container, glides or sliders 44, (typically ¾" diameter, HDPE or poly-tetrafluoroethylene (PTFE)-faced discs specified for up to 1600 pound capacity), are screwed into the top surface of bottom disk 34, assisting ball bearing mechanism 40 to turn smoothly along the bottom surface of top disk 36. The upper face of sliders 44 is snug to bottom face of top disc of platform 36, so that while the turntable offers good rotation with minimal effort, it is not feather-light, and thus does not display non-stop rotation. Thickness dimension of slider 44 are selected so that the slide face rides smoothly but snugly on the wood surface.

In use, rotational platform assembly 32 need not be fastened to the barrel storage system 10, as the recessed bottom lip 31 retains the platform assembly. However, it is preferred to fasten the rotational platform to the barrel bottom 31, e.g. by screws from the inside face of the bottom 31 (not shown), to insure proper alignment, and true rotation about the vertical axis.

Figure 3A:
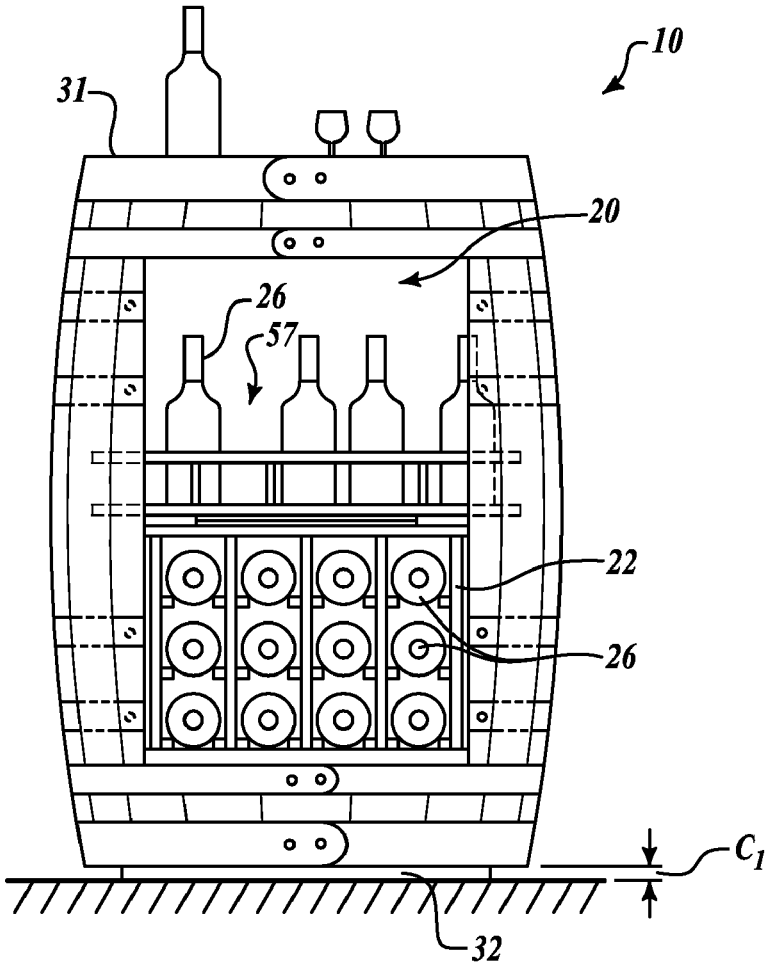
FIGS. 3A, 3C and 3D are rear elevation views of alternate embodiments of the inventive barrel storage system showing a variety of storage shelving and uses, and illustrating the selectively variable floor clearance C1, C2, C3 to compensate for differing floor coverings.
Figure 3B:
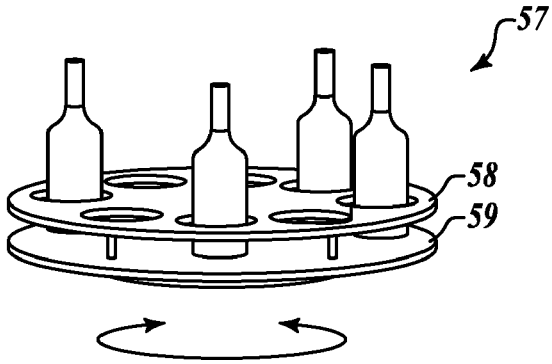
FIG. 3B is an isometric view of the upright bottle storage turntable assembly mounted above a wine rack in the barrel storage system of FIG. 3A.
Figure 3C:
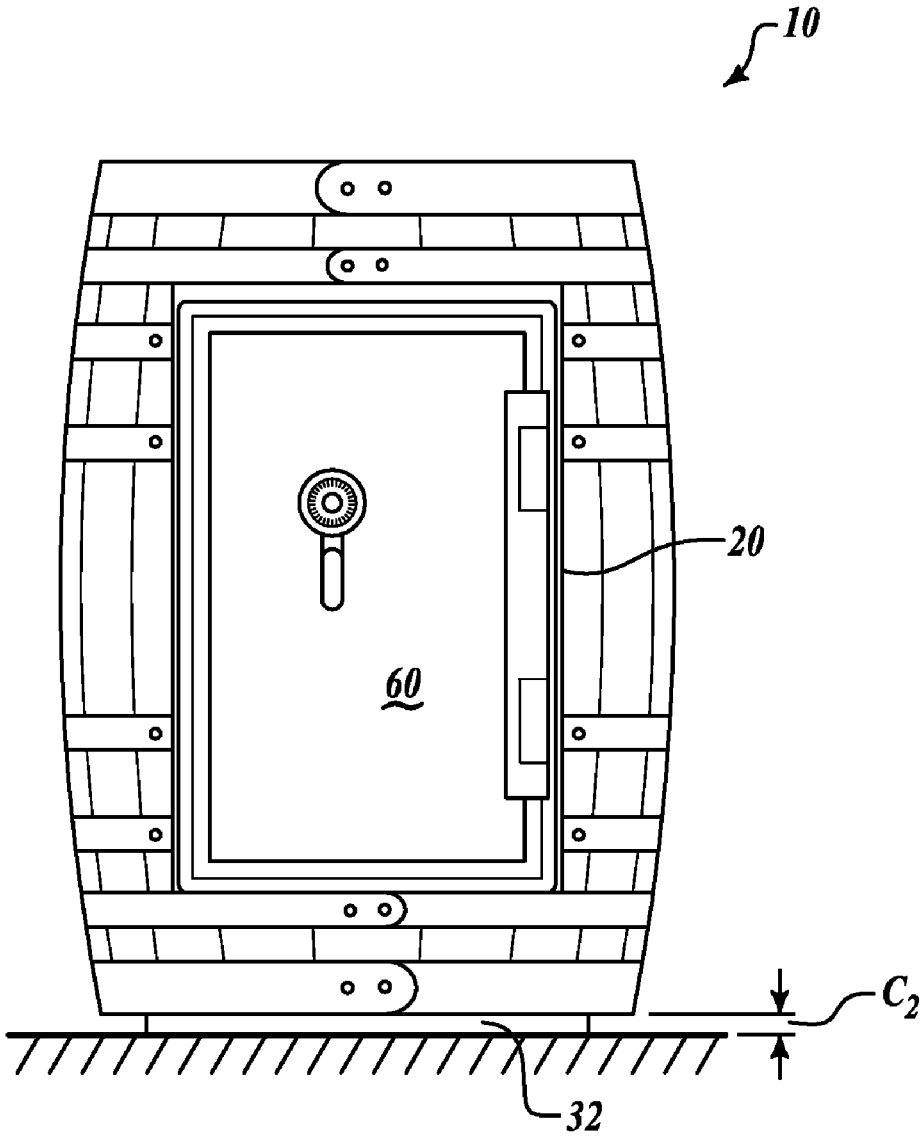
Figure 3D:
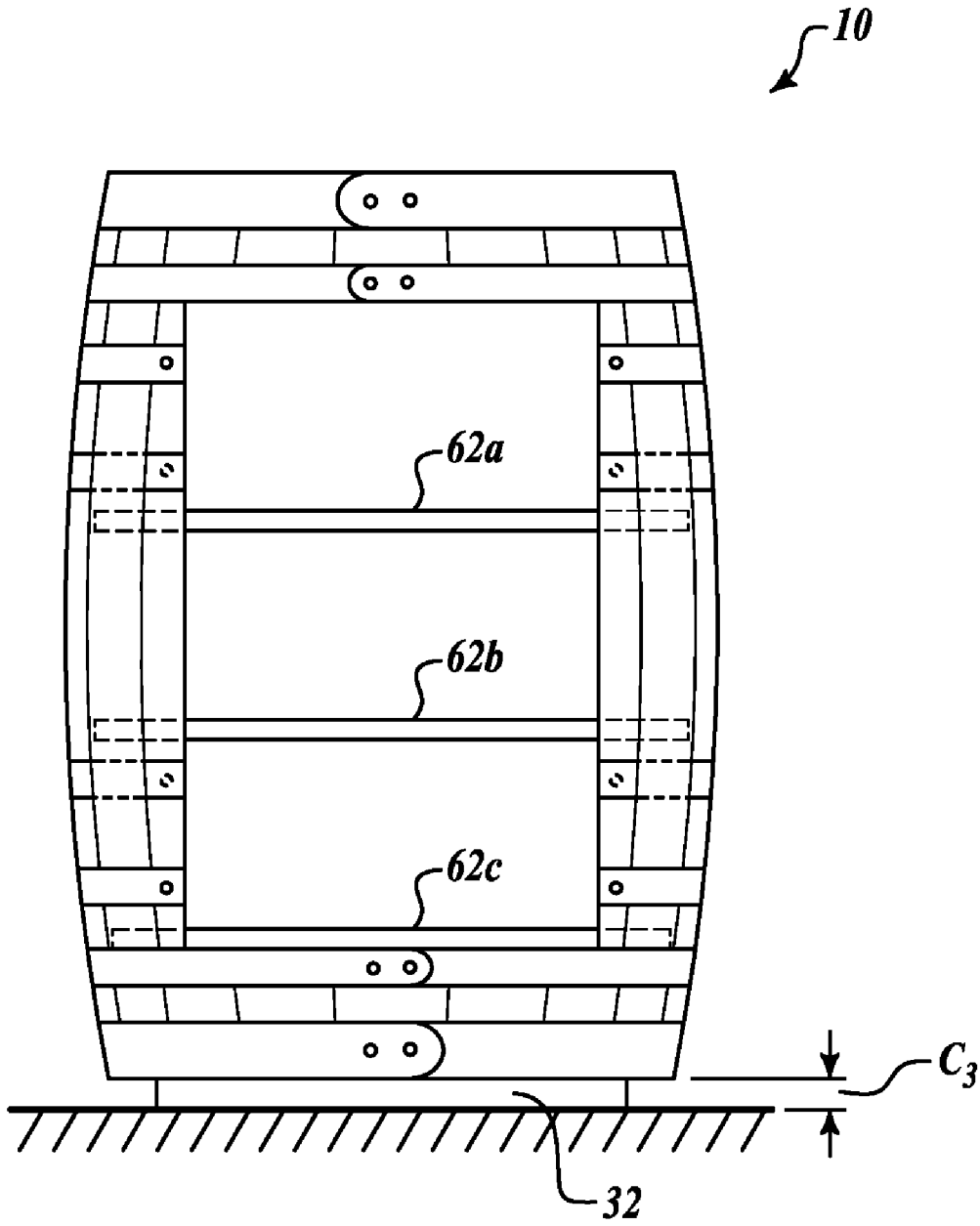

FIGS. 3A 3C and 3D are elevation views showing three alternate embodiments of internal storage fittings for the inventive barrel storage systems and different floor clearances to accommodate different types of flooring. FIG. 3A shows the bottom half of the barrel 12 fitted with a wine rack 22, with a rotating open bottle rack 57 fastened to the top of the wine rack 22, to permit opened bottles of wine or spirits to be retained and served from the top half of the barrel, with access through opening 20. FIG. 3A also shows the barrel top 31 used as a serving platform.

FIG. 3B is an isometric view of the open bottle rack 57 that is fitted in the barrel storage volume, in this embodiment on top of the wine rack 22. It comprises a 2-foot diameter bottle-retainer ring 58 spaced 2-4" above the top of a second turntable assembly 59, which is mounted on a wine bottle storage rack that occupies only about one-half the height of the interior of the barrel. This retainer ring 58 includes a plurality of 4" and 6" holes, which accommodate bottles and jars, preventing them from spilling inside the barrel. The second turntable assembly 59 allows the ring, filled with multiple bottles and jars, to be rotated for ease of access through opening 20.

FIG. 3C shows barrel 10 fitted with an off-the-shelf safe 60 for valuables. When turned so that the safe front is against the wall, the assembly looks like a simple wine barrel. FIG. 3D shows the barrel 10 fitted with simple shelving 62, in this case three shelves 62*a*-62*c*, which can be used for any kind of storage. The space between bottom shelf 62*c* and the top of the bottom end of the barrel is a hidden compartment that can be accessed by lifting the shelf or providing a removable or hinged section in the shelf.

FIGS. 3A-3C also illustrate the variable height of the spacer member(s) of the platform 32 to accommodate different types of flooring. In FIG. 3A, the clearance C-1 is very small, say 1/16" to 1/8" for smooth floors, such as wood, marble, glazed tile, concrete, vinyl sheet-goods and the like type floors. In FIG. 3C, the clearance C-2 is greater, to accommodate more irregular floors, such as brick, pavers, some types of rugs (e.g., outdoor, short nap or Berber rugs), older split plank floors, split slate or rough stone, irregular or country tile (e.g., unglazed Mexican tile) and the like. FIG. 3D the clearance C-3 is still greater, on the order of 3/8" to 5/8" to accommodate thick pile rugs, shag or Rya-type rugs or extremely rough or irregular surfaces.

Figure 4A:
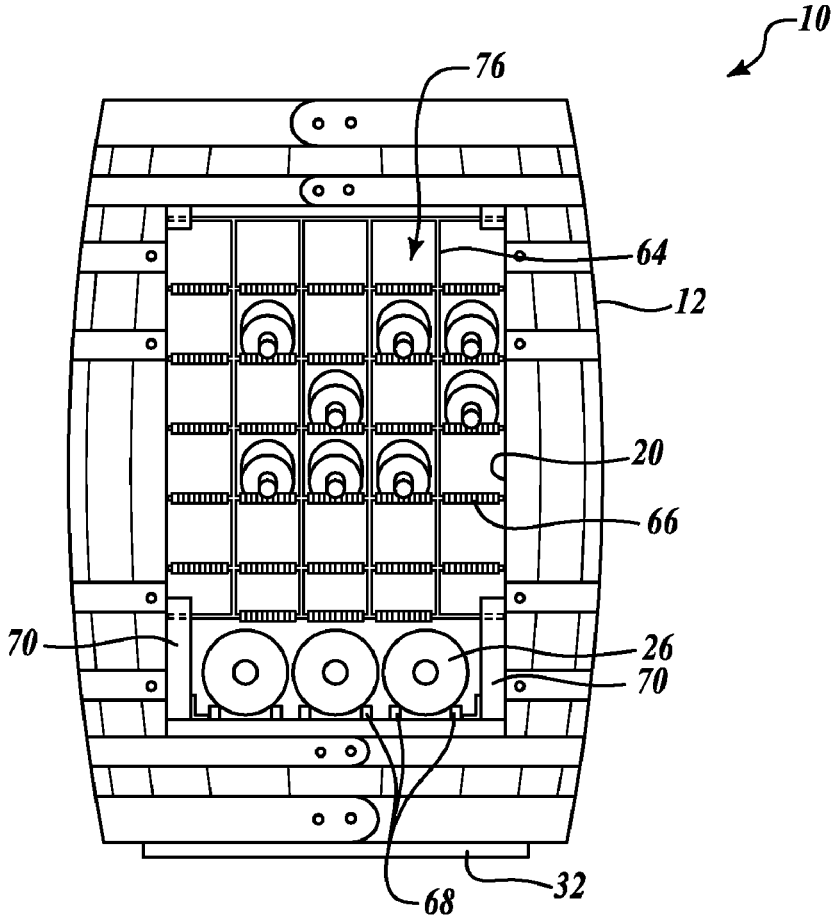
FIG. 4A is a rear elevation view showing a wire rack bottle support system mounted interiorly of the barrel as viewed through the cut-out stave section, and which includes blocks at the bottom for oversized bottles.

FIG. 4A shows the inventive wine barrel storage system 10 in which the barrel 12 is fitted with a fixed-in-place (interior) or roll-out rack system 76, comprising a wire frame 64 (e.g. 1/8" to 1/4" galvanized or stainless steel wire mesh with 4" square openings), the horizontal cross-bars of which are fitted with plastic sleeves 66. The sleeves 66 are typically made of vinyl tubing or corrugated wiring harness sleeves, and can be color-coded, red, white, green, blue yellow, etc. for coded sorting of stored, bottled materials. To accommodate large bottles at the bottom of the rack system, vertical side risers 70 hold the roll-out rack system in place a selected distance above the bottom of the inside of the barrel. Bottle spacer blocks 68, placed on the bottom surface of the inside of the barrel at a selected distance apart from each other, prevent the oversized bottles 26 (such as magnums) placed on the bottom surface from rolling or shifting.

Figure 4B:
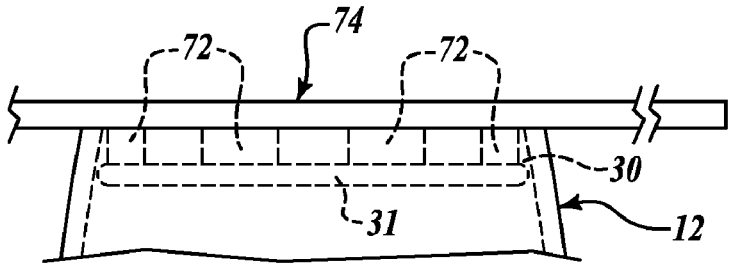
FIG. 4B is a partial elevation view of an alternate embodiment of the inventive barrel storage system with a lift-off table top, the top of the barrel and the spacers being shown in dashed lines.

FIG. 4*b* shows how a lift-off table top 74 can be "popped" or wedged into place using gripping spacer blocks 72 affixed to its underside which fit into the recessed lip 30 of the barrel top 31.

Figure 5:
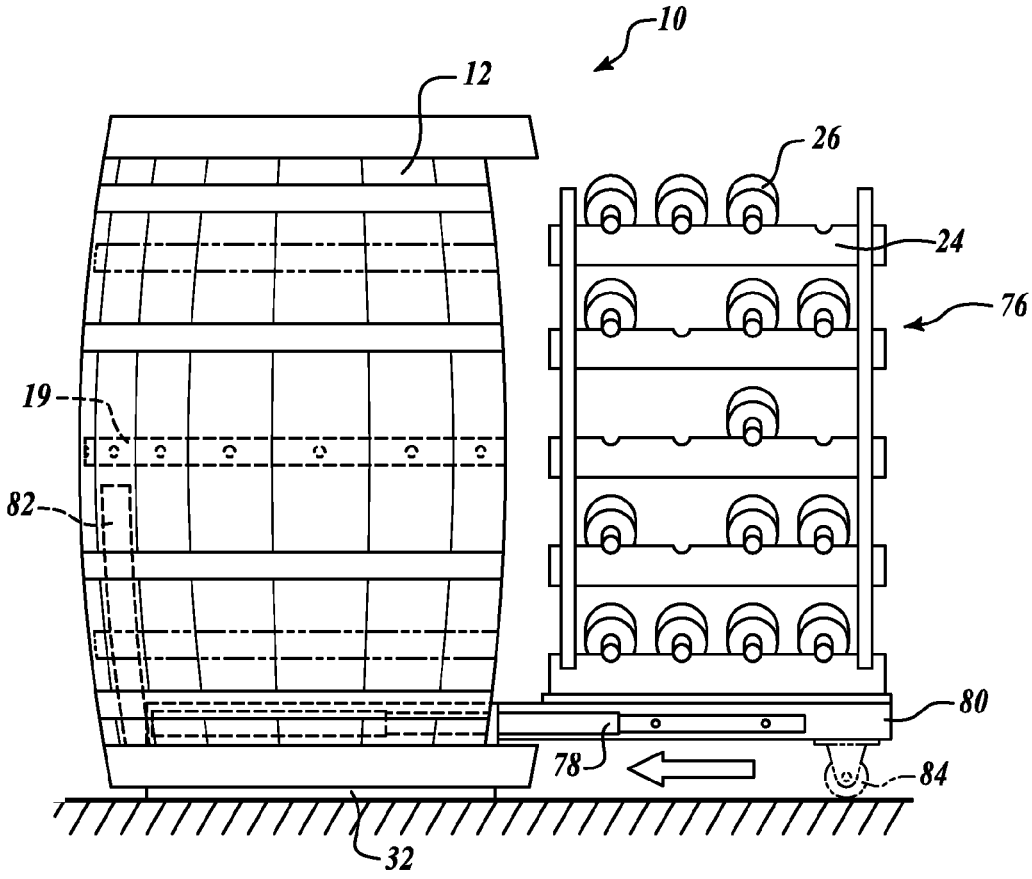
FIG. 5 is a side elevation view of an alternate embodiment of the inventive barrel storage system with a roll-out modular wine-bottle rack system in the extended position.

FIG. 5 shows a modular roll-out type wine rack 76 rack stores wines cross-wise in the barrel storage volume. When the rack is extended out of the barrel as shown, the bottles are accessible. The wine rack can be modular units as shown, or rectangular or square wood, wire or mesh "boxes", open at both ends and having internal "X" spacers so that each holds 4 bottles of wine horizontally. Stackable "X-units" may also be used. The rack 76 rests on or is affixed to the base plate 80, which is secured to internal side rails via heavy duty drawer-type slides 78. One or more counter-weight(s) 82 are placed behind or to the sides of the rack in a manner to not interfere with the wine bottles as they are slid into the storage volume or extended out. In the alternative, a conventional fold-down, latching caster 84 can be used at the outer end of the drawer 80.

Figure 6A:
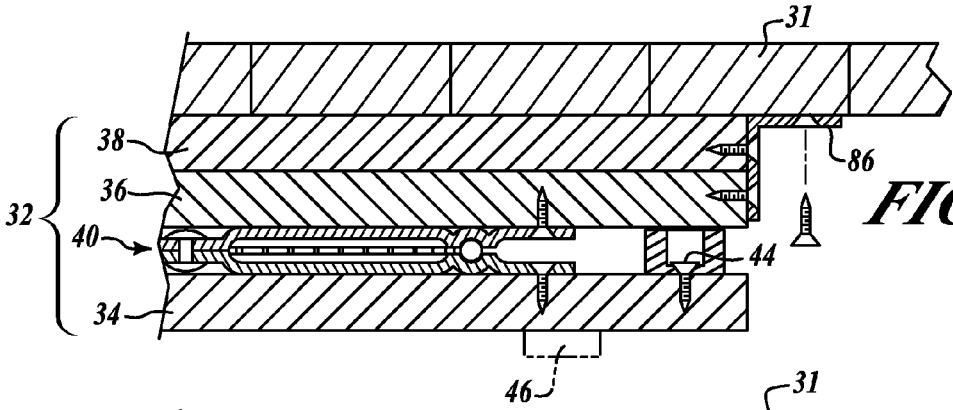
FIGS. 6A-D are section views of the inventive rotational platform showing variations in the mode of fastening it to the bottom of the barrel.

FIG. 6A shows in section view how hardware angle bracket 86 can be used to secure the rotatable platform 32 by screws from the outside to the recessed surface of the barrel bottom 31. Bracket 86 is fastened along the side edges of top disk 36 and spacer disk 38 of platform assembly 32 to attach it to the barrel, while still permitting ball bearing retainer race assembly 41 to turn freely. The friction slider 44 does not interfere. Optionally, spacer feet or glides 46 may be secured to the bottom surface of the platform bottom plate 34 for floor height clearance or to permit laterally sliding the entire assembly to a new location.

Figure 6B:
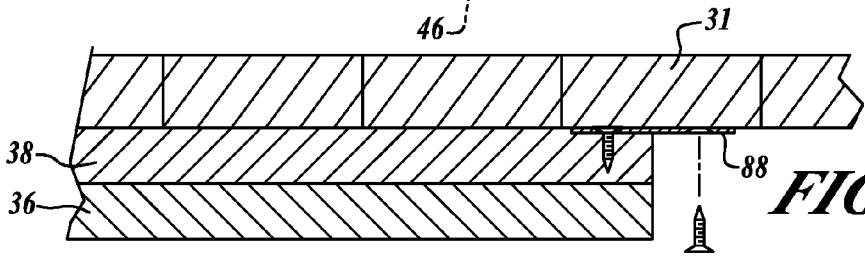

FIG. 6B shows in section view use of a simple connector plate 88 to secure the disk 38 to the bottom of the barrel 31 with oppositely pointing screws.

Figure 6C:
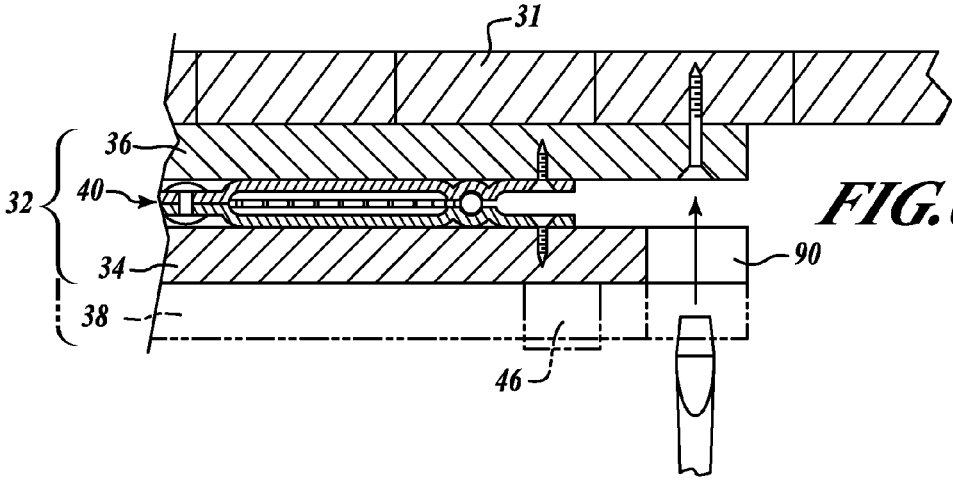

FIG. 6C shows in section view the use of a screwdriver access cut out or notch 90 to permit access by a screwdriver to tighten a tapered-head screw in platform disk 36 to the bottom of the barrel 31.

Figure 6D:
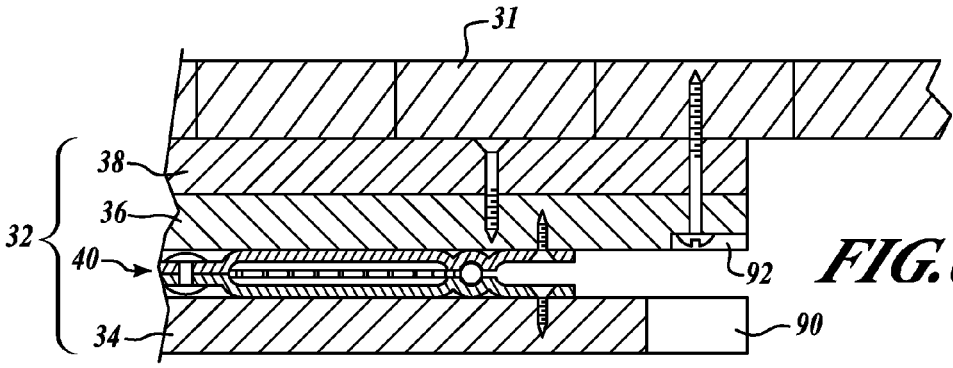

FIG. 6D shows in section view the use of a screwdriver access notch 90 to access a round head screw through both the disks 36 and 38 that is recessed in countersink groove 82.

INDUSTRIAL APPLICABILITY

It is clear that the inventive barrel rotational storage system has wide applicability to functional home décor for those who wish to properly and discretely store more than a few bottles of wine or other valuables. The inventive rotatable platform, its strength reinforced by the use of a plurality of spacer and support disks, elevator bolts, lock washers and gliders, permits the barrel to rotate easily even when filled with heavy items, making it possible to hide its opening against a wall or corner, for increased security and disguised décor. The wide variety of interior and exterior fittings broadens the range of utility of the storage system, and the platform spacers permit it to be easily adapted to a wide range of flooring types so that the barrel appears to float or hover ever so slightly above the floor.

It should be understood that various modifications within the scope of this invention can be made by one of ordinary skill in the art without departing from the spirit thereof and without undue experimentation. For example, the racking can be modified to fit larger or smaller bottles, or some of the inside space may be fitted with a holder for wine glasses instead of solely for wine bottle storage. Regardless of the size of the barrel, parts can be fabricated to transform it into a storage system, whether for wine bottles, standard shelving, media (compact disks, videos and the like) or another type of storage. A door may be fabricated to completely close the access opening, if desired. Rollers may be mounted to the bottom face of bottom plate 34 instead of glides 46. The platform assembly bottom plate 34 can extend outwardly of the barrel bottom lip 31, provided it has a groove that permits clearance of the lip; this embodiment may be used for the slide-out rack of FIG. 5 to permit the outer edge of the rack to slide on an exterior annular ring fitted to the top of plate 34.

PARTS LIST

| | |
|---|---|
| 10 | Barrel Storage System |
| 11 | Barrel top |
| 12 | Wine barrel |
| 14 | Barrel Staves |
| 16 | Full Circumference Hoops |
| 17 | Cut Hoops |
| 18 | Hoop Screws |
| 19 | Internal Partial Hoops |
| 20 | Access Opening |
| 21 | Internal Storage Volume |
| 22 | Wine Rack |
| 24 | Bottle cradle |
| 26 | Bottle |
| 28 | Backing for wine rack |
| 30 | Recessed lip in top and bottom of barrel |
| 31 | Barrel bottom or Top |
| 32 | Rotational Platform Assembly |
| 34 | Bottom disk of platform assembly |
| 35 | Bottom plate of ball bearing turntable |
| 36 | Top disk of rotational platform assembly |
| 37 | Top plate of ball bearing turntable 40 |
| 38 | Spacer disk |
| 40 | Ball Bearing Turntable Assembly |
| 41 | Ball bearing Retainer Race Assembly |
| 42 | Screw Holders |
| 44 | Glides or sliders |
| 46 | Optional Feet or Gliders |
| 48 | Bung Hole |

-continued

| | |
|---|---|
| 50 | Elevator or Connector Bolts |
| 52 | Nuts |
| 54 | Lock Washers |
| 56 | Pre-drilled holes |
| 57 | Vertical Open Bottle Rack |
| 58 | Bottle Horizontal Retainer Ring |
| 59 | Second turntable assembly |
| 60 | Safe |
| 62 | Shelving |
| 64 | Wire Frame |
| 66 | Plastic Sleeves |
| 68 | Bottle Spacer Block |
| 70 | Vertical Side Risers |
| 72 | Gripping Spacer Blocks |
| 74 | Table Top |
| 76 | Roll-Out Rack |
| 78 | Drawer Slide Mechanism |
| 80 | Base Plate of Roll-out Rack |
| 82 | Counterweight |
| 84 | Caster (optional) |
| 86 | Angle Bracket |
| 88 | Flat Plate |
| 90 | Screwdriver Access Notch |
| 92 | Countersink Recess |

The invention claimed is:

1. A barrel storage system, comprising in operative combination:

a) a wooden barrel storage unit having a central axis of rotation and comprising a wooden barrel oriented with its central, longitudinal axis vertical as it rests on a floor during operation as a storage system, said barrel having a continuous vertical side wall consisting of multiple curved staves disposed in a circle having a diameter as seen in transverse cross-section, and a pair of spaced, generally planar end members each having an outer surface and an inner surface, said end members being a first, top end and a second, bottom end, each said end member being recessed inwardly from the respective top and bottom ends of said staves, the space between outer ends of said staves and the surface of each of said end members defining a recess so that there is a top recess and a bottom recess, and a space defined between said staves and said top and bottom end members comprising a storage volume the side wall of said barrel comprising an outer lip of said recess at each end and said barrel is oriented in operative storage orientation with said axis vertical so that one end is a top end and a second end is a bottom end;

b) a rotational platform assembly only for rotating said barrel storage unit on its central axis of rotation including at least a pair of plates, comprising a first, upper plate spaced above a second, lower plate, between which is mounted a rotation assembly mechanism oriented to permit rotation of said barrel around its axis of rotation while vertically oriented, and stabilizing and leveling elide members disposed in a space between said pair of rotational platform plates, said glide members having sliding faces to provide a pre-selected amount of resistance to rotation, so that said barrel storage unit rotates smoothly on said rotational platform but is not free-wheeling and a degree of frictional resistance of said stabilizing elide members is selectively increased or decreased by adjusting a gap between said stabilizing glide members and said upper plate so as to control a clearance between the face of said stabilizing glide members and said upper plate which said stabilizing glide members contact;

c) said platform assembly is disposed in said bottom recess and has a vertical height sufficiently greater than the depth of said bottom recess to provide a minimum clearance of the bottom end of said stave side wall above the surface of a floor on which said barrel rests during its storage operation so that said barrel bottom end rests on said platform assembly and presents a visual appearance of said barrel storage unit floating just above the surface of said floor;

d) said rotation assembly mechanism in combination with said stabilizing glide members provides selected drag resistance to permit ease of rotation of said barrel around its central axis under directed force without tilting and without spinning freely so that said barrel storage unit stops when rotational force is removed or expended, and stays at rest in the new, stopped position while loaded with stored goods;

e) said stave side wall includes a substantially sized opening permitting access to the interior volume of said barrel for introduction and removal of goods for storage, the vertical span of said opening extending from above the inner surface of said bottom end to below the inner surface of said top end and the horizontal width of said opening extending generally less than the diameter of said barrel; and f) said opening being sized so that upon rotation of said barrel on its axis of rotation, said opening can be presented to a first, front position for access to said storage volume, and then rotated to a second, rear storage position wherein said opening is not visible from said front position.

2. A barrel storage system as in claim 1 wherein said platform assembly is secured to said barrel bottom end.

3. A barrel storage system as in claim 2 wherein said platform assembly includes at least one spacer member secured to at least one of said plates.

4. A barrel storage system as in claim 3 wherein said spacer member is selected from a spacer plate, feet and combinations thereof.

5. A barrel storage system as in claim 3 wherein said rotation assembly mechanism comprises a ball bearing turntable mechanism secured between said platform assembly plates.

6. A barrel storage system as in claim 1 which includes a wine rack disposed in at least a portion of said storage volume for access to insert and remove wine bottles through said side wall opening.

7. A barrel storage system as in claim 6 wherein said wine rack occupies approximately half of the vertical height of said storage volume, and which barrel includes a second turntable assembly mounted in the interior, said second turntable assembly including an apertured plate spaced above the second turntable to provide a retainer for holding open bottles in a vertical orientation.

8. A barrel storage system as in claim 6 wherein said rack is modular.

9. A barrel storage system as in claim 6 wherein said rack is mounted on slides to permit said rack to be pulled radially outward from said barrel interior for access to wine bottles oriented transverse to the radially outward direction.

10. A barrel storage system as in claim 9 which includes a counterweight to balance a load on said rack as it is extended.

11. A barrel storage system as in claim 1 wherein said storage volume includes a plurality of vertically spaced shelves.

12. A barrel storage system as in claim 1 wherein said barrel includes a plurality of horizontal external stave-retaining hoops, the hoops that would other-wise span said opening are cut away at the side edges of said opening, and the cut hoops are drilled and fastened to at least two remaining uncut staves.

13. A barrel storage system as in claim 12 which includes at least one partial hoop that is disposed on the interior surface of the barrel wall and secured to each of the remaining uncut staves.

14. A barrel storage system as in claim 1 which includes at least one shelf or drawer that can be pulled radially outwardly from said interior.

15. A barrel storage system as in claim 1 which includes a table-top comprising a plate having a top surface and a bottom surface, and a plurality of vertical spacer members secured to the bottom surface and disposed to fit securely in the top recess of said barrel to provide a non-tip frictional fit of said spacers in said recess.

16. A barrel storage system as in claim 15 which includes a wine rack disposed in at least a portion of said storage volume for access to insert and remove wine bottles through said side wall opening.

17. A barrel storage system as in claim 1 wherein said barrel is a wine barrel, said platform assembly is secured to said barrel bottom end, and said rotation assembly mechanism comprises a ball bearing turntable mechanism secured between said platform assembly plates.

18. A barrel storage system as in claim 17 including a spacer member secured to at least one of said plates which is selected from a spacer plate, feet and combinations thereof.

19. A barrel storage system as in claim 1 which includes a lazy susan assembly mounted in said storage volume.

20. A barrel storage system as in claim 19 wherein said lazy susan assembly comprises a pair of vertically spaced plates, one upper plate and a lower plate, said two plates rotate together on a rotation mechanism disposed annularly below said lower plate, and said upper plate includes a plurality of circular apertures for retaining bottles in a vertical orientation.

* * * * *